United States Patent [19]

Oshiro et al.

[11] Patent Number: 4,930,707

[45] Date of Patent: Jun. 5, 1990

[54] PNEUMATIC PULVERIZER AND PULVERIZING METHOD

[75] Inventors: Mayumi Kashiwagi, Tokyo; Toshiaki Sasaki, Abiko; Satoshi Mitsumura, Tokyo; Masayoshi Kato, Iruma, all of

[73] Assignee: Canon Kabushiki Kaisha, Tokyo, Japan

[21] Appl. No.: 271,917

[22] Filed: Nov. 16, 1988

[30] Foreign Application Priority Data

Nov. 18, 1987 [JP] Japan ..... 62-289638

[51] Int. Cl.[5] ..... B02C 19/06

[52] U.S. Cl. ..... 241/5; 241/24; 241/29; 241/40; 241/80; 241/152 R

[58] Field of Search ..... 241/5, 39, 40, 80, 97, 241/24, 79.1, 300, 29, 152 R

[56] References Cited

U.S. PATENT DOCUMENTS

| | | | |
|---|---|---|---|
| 251,803 | 1/1882 | Starkey | 241/40 X |
| 2,055,385 | 9/1936 | Noack | 241/40 X |
| 3,312,342 | 4/1967 | Brown | 241/40 X |
| 3,482,786 | 12/1969 | Hogg | 241/40 X |

FOREIGN PATENT DOCUMENTS

| | | | |
|---|---|---|---|
| 20167 | 2/1978 | Japan | 241/40 |
| 050554 | 3/1982 | Japan . | |
| 143853 | 8/1983 | Japan . | |

*Primary Examiner*—Mark Rosenbaum

*Attorney, Agent, or Firm*—Fitzpatrick, Cella, Harper & Scinto

[57] ABSTRACT

A pneumatic pulverizer comprises an accelerating pipe for conveying and accelerating powder by a high pressure gas, a pulverizing chamber and an impinging member which pulverizes the powder jetted out from the accelerating pipe through impinging force. The impinging member is provided in the pulverizing chamber as opposed to the accelerating pipe outlet and the impinging member has an impinging surface with a tip portion having a conical shape with an apex angle of 110° to 175°. In this way, powder is pulverized at the impinging surface of the impinging member and dispersed substantially in the entire circumferential direction after impinging and the powder dispersed may impinge secondarily on the wall of the pulverizing chamber.

27 Claims, 15 Drawing Sheets

PNEUMATIC PULVERIZER AND PULVERIZING METHOD

BACKGROUND OF THE INVENTION

1. Field of the Invention

This invention relates to a pneumatic pulverizer and pulverizing method by use of a jet gas stream (high pressure gas). Particularly, the present invention pertains to a pneumatic pulverizer and pulverizing method for forming toner or colorant resin powder with an toner to be used for image forming method such as electrophotography with good efficiency.

2. Related Background Art

Toner or colorant resin powder for toner to be used for an image forming method such as electrophotography generally contains at least a binder resin and a colorant or magnetic powder. Toner develops the electrostatic image formed on a latent image carrier, and the toner image formed is transferred onto a transfer material such as plain paper or plastic film. Then the toner image on the transfer material is fixed by a fixing device such as a heating fixing means, a pressure roller fixing means or a heating pressurization roller fixing means. Accordingly, the binder resin to be used in toner has the characteristic of plastic deformation when heat and/or pressure is applied.

Presently, toner or colorant resin powder for toner is prepared by melting and kneading a mixture containing at least a binder resin and a colorant or magnetic powder (further containing, if desired, a third component), cooling the melted and kneaded mixture, pulverizing the cooled product and classifying the pulverized product. Pulverization of the cooled product is practiced generally by coarsely (or moderately) pulverizing the product by means of a mechanical impact mill and then subsequently finely pulverizing the pulverized coarse powder by means of a pneumatic pulverizer using a jet gas stream.

Pneumatic pulverizer by use of a jet gas stream conveys the starting powder with a jet gas stream and permits the starting powder to impinge on an impinging member, thereby pulverizing the powder through its impact force.

In the prior art, the impinging surface 14 of the impinging member used in such a pulverizer had a planar shape vertical to or slanted at an angle of, for example, 45° relative to the jet gas stream direction (the axial direction of the accelerating pipe) carrying the starting powder, as shown in FIG. 5, FIG. 6 and FIG. 8 (see Japanese Laid-open Patent Publications Nos. 57-50554 and 58-143853).

In the pulverizer shown in FIG. 5, the starting powder having a coarse particle size is fed from the throwing inlet 1 into the accelerating pipe 3, and the starting powder is thrashed with the jet gas stream blown out from the jet nozzle 2 against the impinging surface 14 of the impinging member 4 to be pulverized through its impact force, and discharged out of the pulverizing chamber from the discharging outlet 5. However, when the impinging surface 14 is vertical to the axial direction of the accelerating pipe 3, the starting powder blown out from the jet nozzle 2 and the powder reflected against the impinging surface 14 will coexist at a higher rate, whereby the powder concentration in the vicinity of the impinging surface 14 becomes higher to give poor pulverization efficiency. Further, pulverization is effected mainly due to primary impingement on the impinging surface 14, and therefore it cannot be said that secondary impingement on the pulverizing chamber wall 6 is effectively utilized. Further, in a pulverizer wherein the angle of the impinging surface is vertical to the accelerating pipe 3, fusion and aggleomerated product are liable to be generated due to local heat generation during pulverization of a thermoplastic resin, whereby stable running of the device is difficult and causes a reduction in pulverizing ability. For this reason, it has been difficult to use powder at high concentration.

In the pulverizer shown in FIG. 6, in which the impinging surface 14 is slanted relative to the axial direction of the accelerating pipe 3, the powder concentration in the vicinity of the impinging surface 14 becomes lower as compared with the pulverizer shown in FIG. 5, but the pulverization pressure is dispersed and lowered. Further, it cannot be said that the secondary impingement on the pulverizing chamber wall 6 is effectively utilized.

As shown in FIG. 6 and FIG. 7, in a device having an impinging surface 14 slanted at an angle of 45° relative to the accelerating pipe, there is little problem as mentioned above during pulverization of a thermoplastic resin. However, because the impact force used for pulverizing during impingement is small, and further pulverization through secondary impingement on the pulverizing chamber wall 6 is little, the pulverizing ability will drop to ½ to 1/1.5 as compared with that of the pulverizer shown in FIG. 4.

The pulverizer shown in FIG. 8, wherein the impinging surface 14 is slanted downward relative to the axial direction of the accelerating pipe 3, the powder concentration in the vicinity of the impinging surface 14 becomes lower as compared with the pulverizer shown in FIG. 5. Further, although secondary impingement on the pulverizing chamber wall 6 is effectively utilized, as shown in FIG. 9, only the lower wall surface is substantially utilized in secondary impingement on the pulverizing chamber wall 6. Accordingly, it would be desirable to have a pulverizer and a pulverizing method having much better pulverization efficiency.

SUMMARY OF THE INVENTION

An object of the present invention is to provide a pneumatic pulverizer and a pulverizing method which resolves the problems discussed above.

Another object of the present invention is to provide a pneumatic pulverizer and a pulverizing method which can pulverize powder comprising mainly a thermoplastic resin with good efficiency.

Still another object of the present invention is to provide a pneumatic pulverizer and a pulverizing method in which fusion of the powdery starting material and the pulverized powder within the pulverizing chamber is difficult.

Still another object of the present invention is to provide a pneumatic pulverizer and a pulverizing method in which fusion of the powdery starting material and the pulverized powder is inhibited with little formation of agglomerated product and coarse particles even when the amount of the powdery starting material treated may be increased.

Still another object of the present invention is to provide a pneumatic pulverizer capable of pulverizing the powdery starting material comprising mainly a thermoplastic resin such as a polyester resin or a styrene type resin (e.g. styrene-acrylate copolymer or styrene-methacrylate copolymer) with good efficiency.

Still another object of the present invention is to provide a pneumatic pulverizer capable of forming colorant resin particles for toner or a toner to be used for a copying machine and printer having a heating pressurizing roller fixing means with good efficiency.

Still another object of the present invention is to provide a pneumatic pulverizer capable of fine grinding resin particles having an average particle size of 30 to 1000 μm into particles having an average particle size of 5 to 15 μm with good efficiency.

Still another object of the present invention is to provide a pneumatic pulverizer to reduce coarse or medium powder into substantially fine powder having a sharp particle size distribution.

Still another object of the present invention is to provide a method for pneumatically pulverizing coarse or medium powder into fine powder having a sharp particle size distribution.

Still another object of the present invention is to provide a pneumatic pulverizer and a pneumatic pulverization method which forms toner particles or colorant resin particles for toner to be used for an image forming method by use of an electrophotographic method.

In one aspect of the present invention, there is provided a pneumatic pulverizer comprising an accelerating pipe for conveying and accelerating powder by a higher pressure gas, a pulverizing chamber and an impinging member which pulverizes the powder jetted out from said accelerating pipe through impinging force, said impinging member being provided in the pulverizing chamber as opposed to the accelerating pipe outlet and said impinging member having an impinging surface with a tip portion having a conical shape with an apex angle of 110° to 175° so that powder may be pulverized at the impinging surface of said impinging member to be dispersed substantially in the entire circumferential direction after impinging and said powder dispersed may impinge secondarily against the wall of the pulverizing chamber.

In another aspect of the present invention, there is provided a method for pneumatically pulverizing powder, comprising converying and accelerating powder by a high pressure gas within an accelerating pipe, discharging the powder from the accelerating pipe outlet into a pulverizing chamber, pulverizing the powder by permitting the powder to impinge on the impinging surface of an impinging member having the impinging surface with a tip end portion having a conical shape with an apex angle of 110° to 175°, dispersing the impinged powder substantially in the whole circumferential direction, and further pulverizing the powder by permitting said powder to impinge secondarily against the pulverizing chamber wall.

DETAILED DESCRIPTION OF THE INVENTION

The pneumatic pulverizer of the present invention can pulverize powder of a thermoplastic resin or powder comprising a thermoplastic resin as the main component to the order of several μm by utilizing a high speed gas stream with good efficiency.

Figure 1:
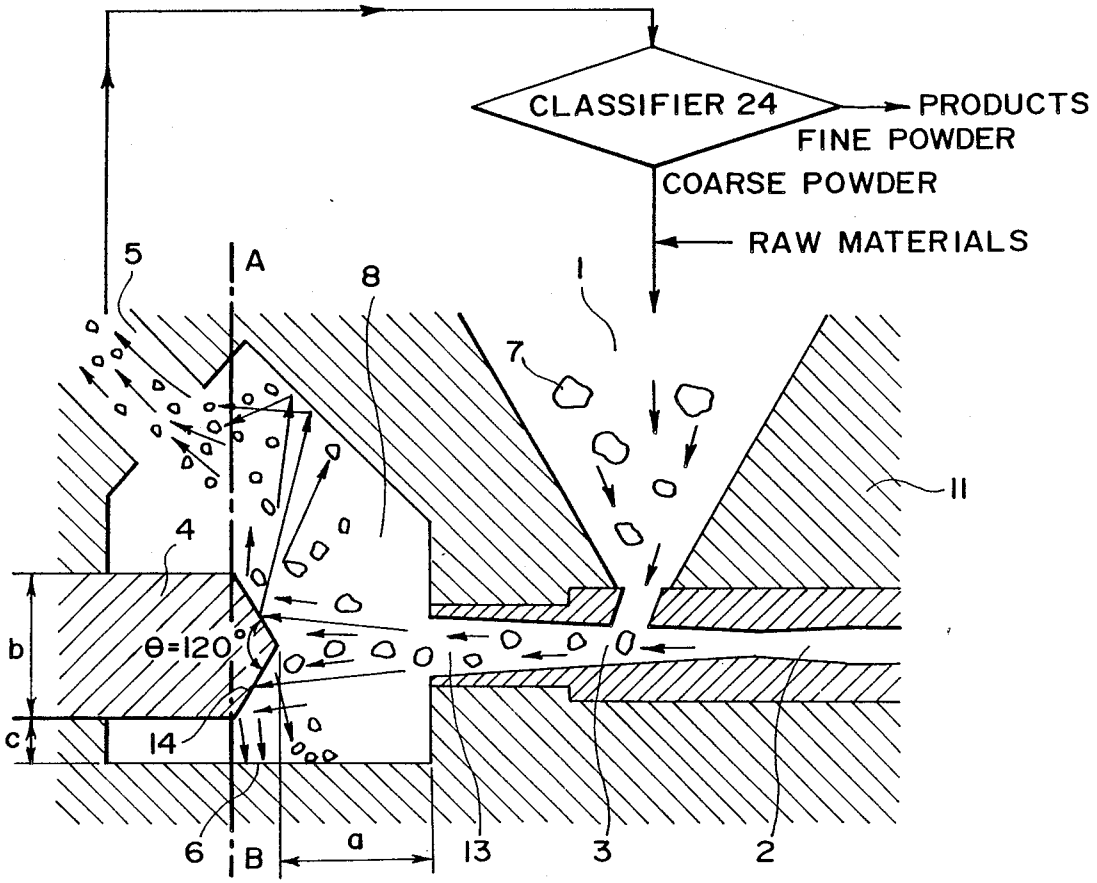
FIG. 1 illustrates schematically a cross-section of the pneumatic pulverizer of the present invention with the impinging surface of the impinging member having an apex angle of 120° and the pulverization-classification steps.
Figure 2:
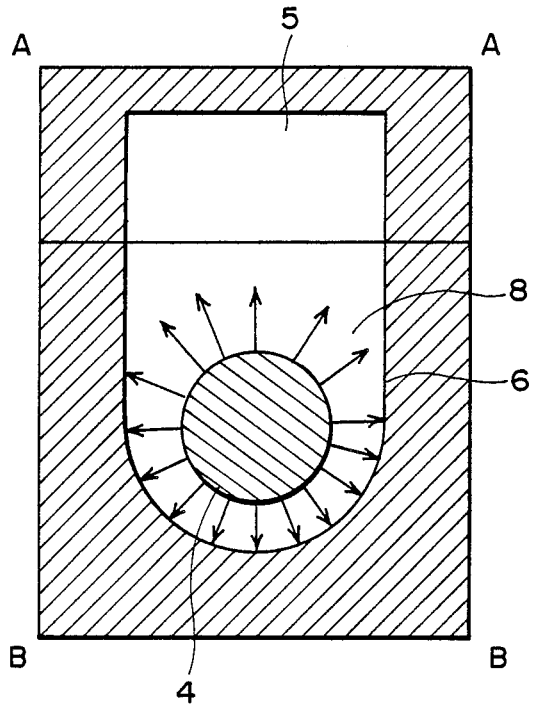
FIG. 2 illustrates schematically a cross-section at the A-B plane of the pneumatic pulverizer shown in FIG. 2.
Figure 14:
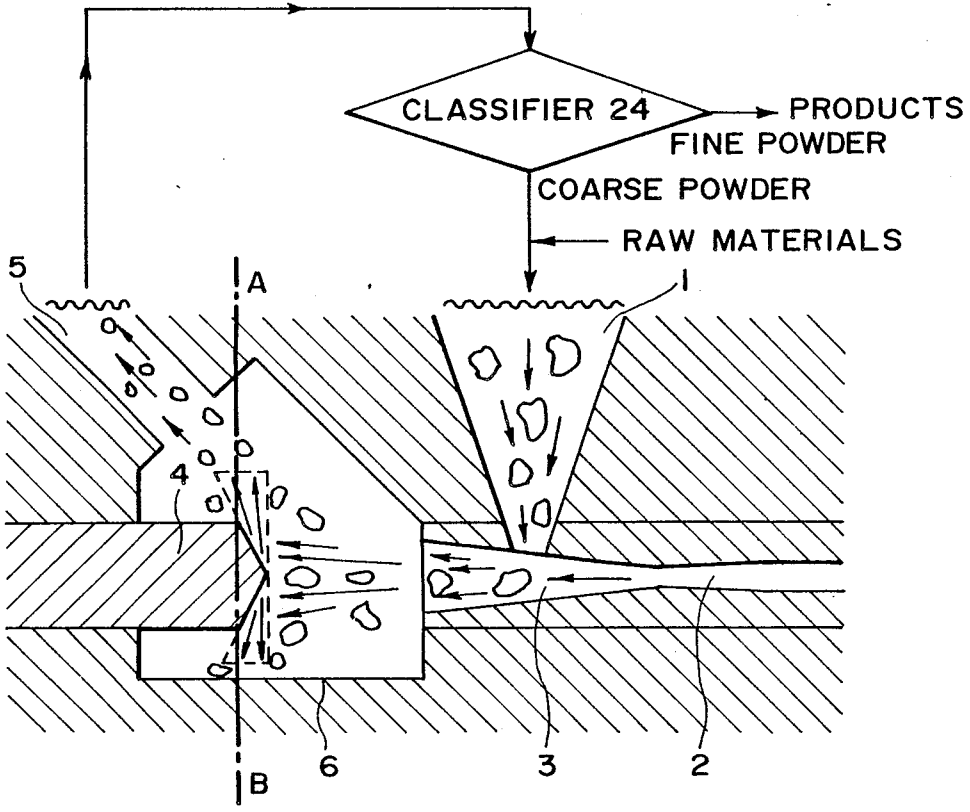

The present invention is described by referring to the accompanying drawings. FIG. 1 illustrates schematically a cross-section of the pneumatic pulverizer of the present invention and a flow chart of the pulverizing method comprising a combination of the pulverizing step by use of said pulverizer and the classifying step by use of a classifier. The powdery starting material 7 to be pulverized is fed from the powdery throwing inlet 1 provided at the pulverizer wall 11 above the accelerating pipe 3 into the accelerating pipe 3. Into the accelerating pipe 3, a compressed gas such as compressed air is introduced from the compressed gas feed nozzle 2, and the powdery starting material 7 fed into the accelerating pipe is momentarily accelerated to have high velocity. The powdery starting material discharged at high velocity from the accelerating pipe outlet 13 into the pulverizing chamber 8 impinges on the impinging surface 14 of the impinging member 4 to be pulverized. In the pulverizer shown in FIG. 1, since the impinging surface 14 has a conical shape having an apex angle of 120°, the pulverized powder is dispersed substantially in the entire circumferential direction, thereby causing secondary impingement on the pulverizing chamber wall 6 to be further pulverized. FIG. 2 schematically illustrates the cross-section at the A-B plane in the pneumatic pulverizer shown in FIG. 1, which shows schematically the dispersed state of the powder after impingement on the impinging surface 14. From FIG. 2, it can be seen that the secondary impingement of powder on the pulverizing chamber wall 6 is effectively utilized in the pneumatic pulverizer of the present invention. Further, in the pulverizer of the present invention, as shown in FIG. 14, the powder is diffused on the impinging surface 14 well in the axial direction of the impinging member, and therefore most of the pulverizing chamber wall 6 can be used for secondary impingement. For this reason, the concentration of powder in the vicinity of the impinging surface 14 does not become concentrated, whereby treatment efficiency of powder can be improved and fusion and sticking of powder on the impinging surface 14 can be inhibited.

The powder introduced into the pulverizing chamber 8 is pulverized by primary impingement on the impinging surface 14, and further pulverized secondary impingement on the pulverizing chamber wall 6. In some cases, the pulverized powder may be further pulverized by tertiary (and quartic) impingement on the pulverizing chamber wall 6 until conveyed to the discharging outlet 5. The powder discharged from the discharging outlet 5 is classified into fine powder and coarse powder by a classifier such as fixed wall system pneumatic classifier. The fine powder classified may be used as such as the product or further classified, if necessary, before use as the product. The coarse powder classified is thrown into the powdery starting raw material throwing inlet 1 together with the new powdery starting material.

The case when the pulverized powder is used as the toner or the colorant resin particles for toner of a developer for electrophotography is to be further described.

Toner is constituted of powder having an average particle size of 5 to 20 μm. Toner may be formed of colorant resin particles for toner themselves in some cases, while it may also formed of colorant resin particles for toner and an additive such as silica in other cases. Colorant resin particles for toner are comprised of a binder resin and a colorant or magnetic powder, containing further optionally an additive such as a charge controlling agent and/or an off-set preventive agent. As the binder resin, a styrene type resin, an epoxy type resin or a polyester type resin having a glass transition point (Tg) of 50° to 120° C. may be employed. As the colorant, various dyes or pigments such as carbon black, nigrosine type dyes or phthalocyanine type dyes may be used. As the magnetic powder, powder of a metal or a metal oxide which can be magnetized by a magnetic or field such as iron, magnetite, ferrite can be used.

A mixture of a binder resin or a colorant (or magnetic powder) is melted and kneaded, then cooled and the cooled product is crushed or pulverized moderately to prepare starting raw material powder with an average particle size of 30 to 1000 μm. The powdery starting material thrown from the powdery starting material throwing inlet 1 is momentarily accelerated in the accelerating pipe 3 into which compressed air having a pressure of 3 to 10 kgf/cm$^2$ is supplied to have a high velocity of 300 to 400 m/s. The powdery starting material having a high velocity of 300 to 400 m/s is discharged from the accelerating pipe outlet 13 into the pulverizing chamber 8. The impinging member 4 is susceptible to abrasion, and therefore ceramics such as aluminum oxide or substrates of stainless steel subjected to ceramic coating on the surface by flame spray coating of ceramics may be employed. Similarly, the pulverizing chamber wall should preferably be formed of ceramics at least on the surface.

The impinging member 4 has a shape of a circular cylinder or a polygonal cylinder, and in the case of circular cylinder, one having a diameter (b) generally of 40 to 500 mm is used. The tip portion of the impinging member 4 opposed to the accelerating pipe outlet 13 has a conical shape. The tip portion of the impinging member 4 has an apex angle of 110° to 175° (preferably 120° to 170°). If the apex angle of the cone is less than 110°, the impinging force during pulverization is smaller, while if the apex of the cone exceeds 175°, the powdery starting material is liable to be fused onto the impinging member surface, whereby the amount of powder treated is increased with difficulty.

The accelerating pipe outlet 13 has an inner diameter generally of 10 to 100 mm, preferably the inner diameter is smaller than the diameter (b) of the impinging member 4. The tip end of the impinging member 4 should be preferably made substantially coincident (with deviation within 10 mm) with the center axis of the accelerating pipe 3 for uniformization of pulverization.

The distance (a) between the accelerating outlet 13 and the tip end of the impinging member 4 should be preferably 0.5 to 2-fold of the diameter (b) of the impinging member 4. If it is shorter than 0.5-fold, excessive pulverization tends to occur, while if it exceeds 2-fold, pulverization efficiency tends to be lowered.

Figure 15:
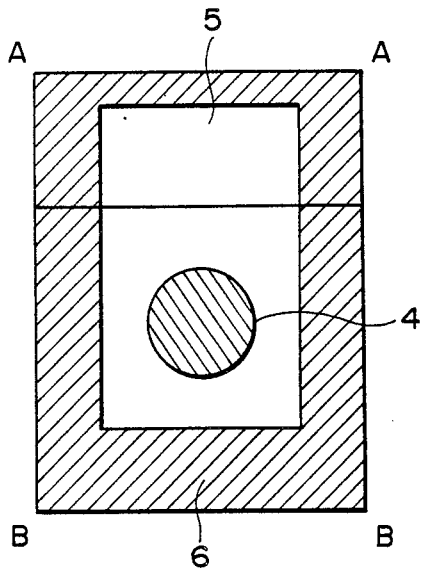

The shortest distance (c) between the impinging member 4 and the pulverizing chamber wall 6 should be preferably 0.1 to 1-fold of the diameter (b) of the impinging member 4. If it is less than 0.1-fold, excessive pulverization is liable to occur and also there is the tendency that the powder cannot flow smoothly. On the other hand, if it exceeds 1-fold, pulverization efficiency tends to be lowered. The pulverizing chamber wall 6 on which powder impinges should preferably have a U-shape as shown in FIG. 2 for prevention of fusion and sticking of powder and uniformization of pulverization. The pulverizing chamber wall 6 can have a rectangular or square shape as shown in FIG. 15 for practicing the invention, but fusion of powder will more readily occur as compared with the case of a U-shape as shown in FIG. 2.

Figure 12:
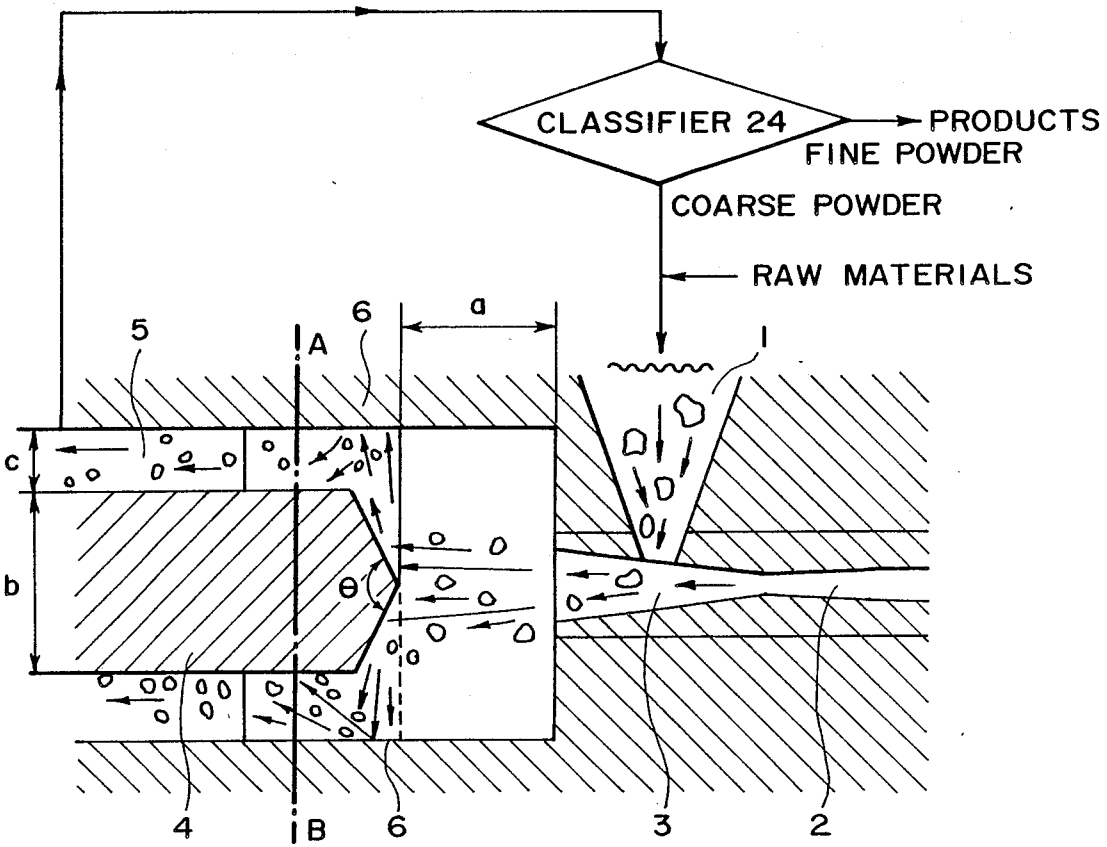
FIGS. 12 through 15 illustrate cross-sections of the pneumatic pulverizer of another embodiment of the present invention and pulverization-classification steps.

FIG. 12 is a pneumatic pulverizer according to another embodiment of the present invention, in which a discharging outlet of pulverized powder is provided in the axial direction of the impinging member 4.

Figure 3:
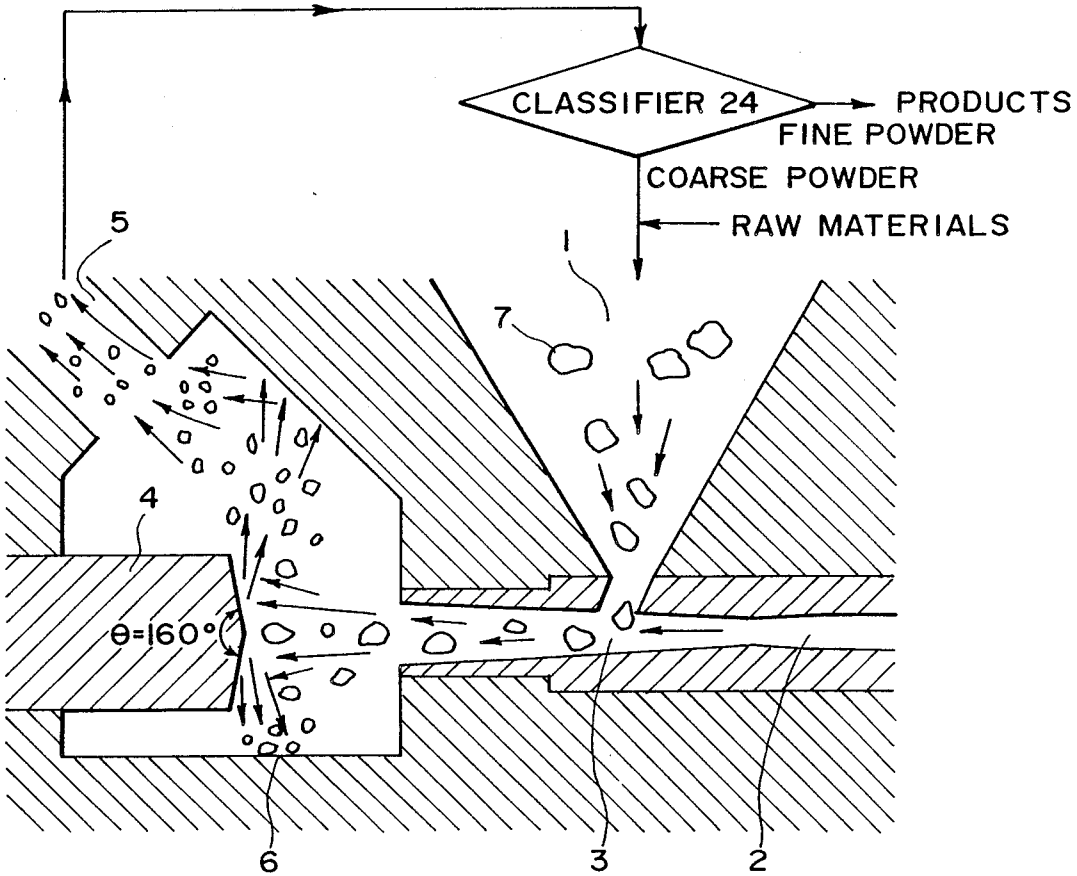
FIG. 3 and FIG. 4 illustrate schematically a cross-section of the pneumatic pulverizer of the present invention with the impinging surface of the impinging member having an apex angle of 160° and 170° respectively and the pulverization-classification steps.
Figure 4:
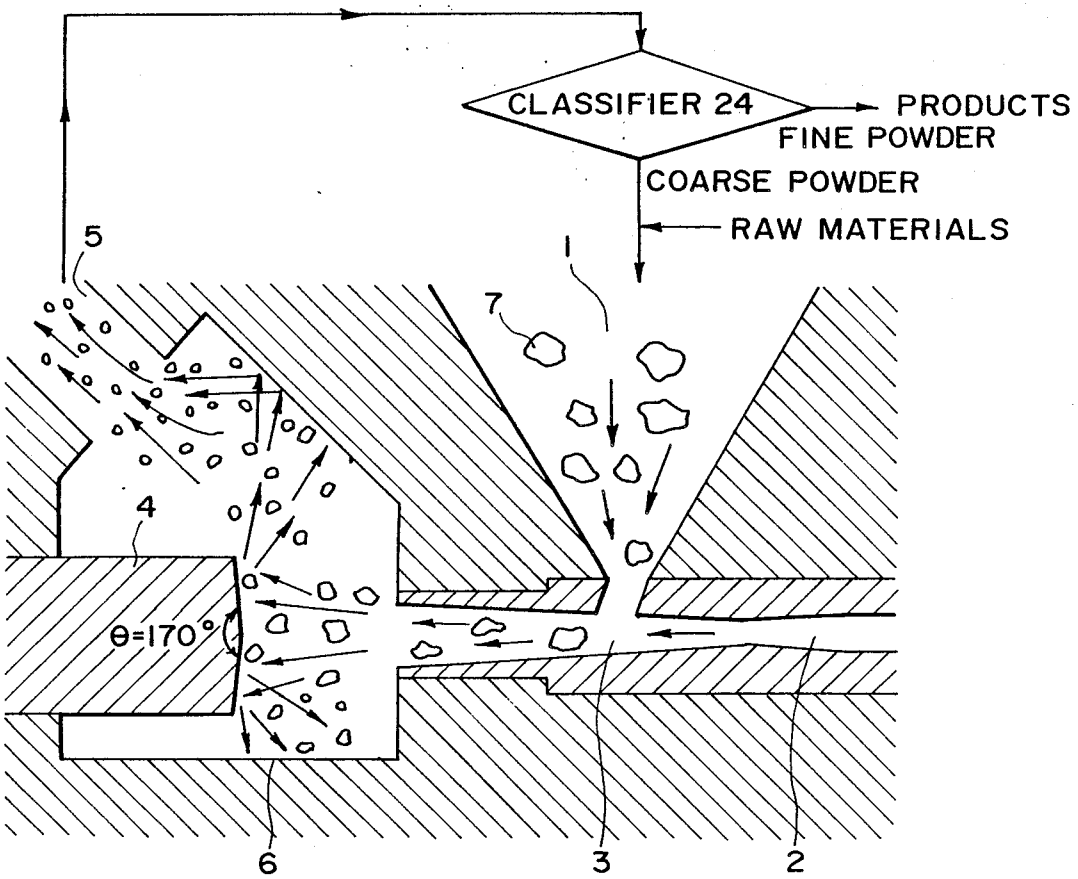

FIG. 3 and FIG. 4 illustrate a pulverizer having an apex angle at the conical portion of 160° and 170° respectively.

Figure 5:
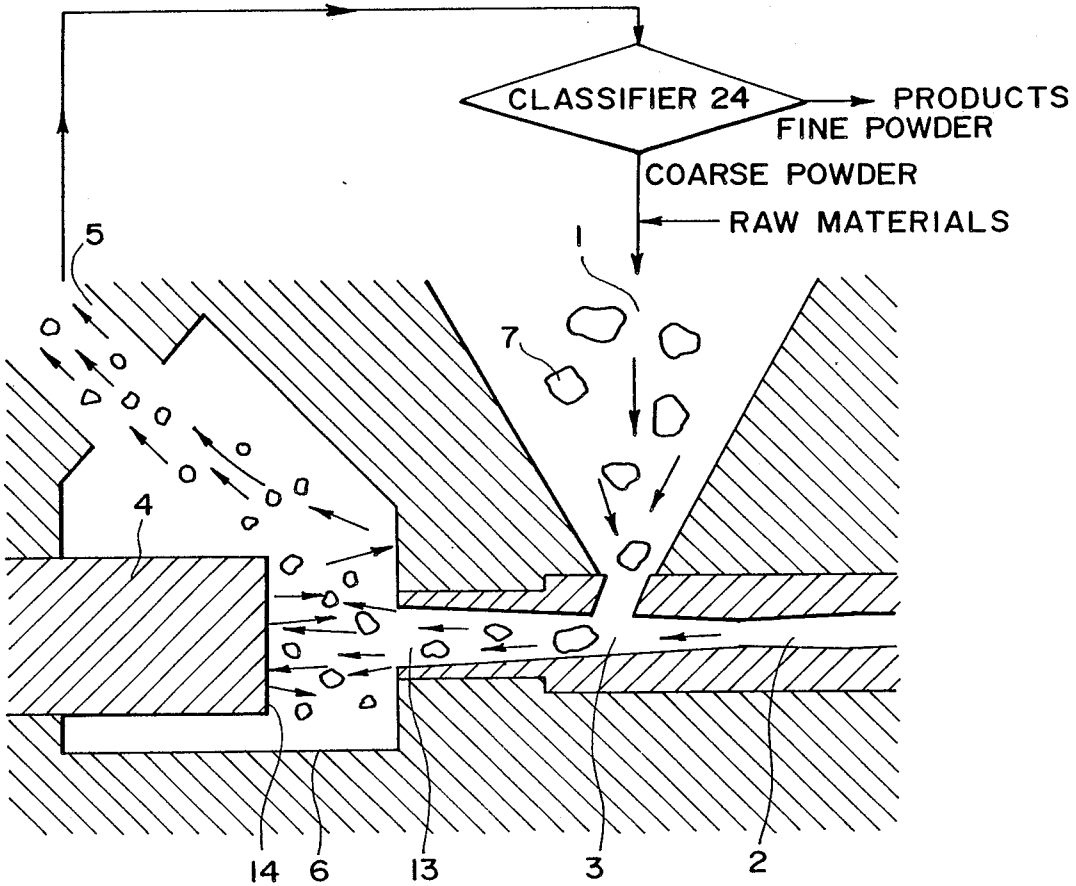
FIG. 5 PRIOR ART
FIG. 5 illustrates schematically a cross-section of a pneumatic pulverizer as a comparative example with the impinging surface of the impinging member being vertical to the axial direction of the accelerating pipe and pulverization-classification steps.

When the pneumatic pulverizer of the present invention is used, it is possible to achieve a pulverization efficiency of about 1.2 to about 3.3, with the pulverization efficiency of the pulverizer shown in FIG. 5 being 1.

The prevent invention is described below in more detail by referring to Examples and Comparative examples.

EXAMPLE 1

By use of a pneumatic pulverizer shown in the accompanying drawings FIG. 1 and FIG. 2, powder was pulverized. As the classifying means for classifying the pulverized powder into fine powder and coarse powder, a fixed wall system air classifier was employed.

The pneumatic pulverizer has a circular cylindrical impinging member 4 formed of an aluminum oxide type ceramic having a diameter (b) of 60 mm, and the tip portion of the impinging member 4 had a conical shape with an apex angle of 120°. Further, the inner wall of the pulverizing chamber 8 was coated with ceramic. The accelerating pipe outlet 13 had an inner diameter of 25 mm, and the center axis of the accelerating pipe 3 was coincident with the tip end of the impinging member 4. The shortest distance (a) from the accelerating pipe outlet 13 to the impinging surface 14 was 60 mm, and the shortest distance (c) between the impinging member 4 and the pulverizing chamber wall 6 was 20 mm. The cross-section at the A-B plane of the pneumatic pulverizer had a U-shape as shown in FIG. 2. The distances of the impinging member 4 left and right and below from the pulverizing chamber wall 6 were 20 to about 40 mm.

As the powder starting material, the following composition was used.

| | |
|---|---|
| Polyester resin (weight average molecular weight (Mw) = 50000; Tg = 60° C.) | 100 parts by weight |
| Phthalocyanine type pigment | 6 parts by weight |
| Low molecular weight polyethylene | 2 parts by weight |
| Negatively chargeable controlling agent (azo type metal complex) | 2 parts by weight |

The toner starting material comprising a mixture of the above recipe was melted and kneaded at about 180° C. for about 1.0 hour, solidified by cooling and the melted and kneaded product cooled was crushed by a hammer mill into particles of 100 to 1000 μm and used as the powdery starting raw material.

When the powdery starting material was fed through the throwing inlet 1 at a rate of 30 kg/h, the powdery starting material was accelerated in the accelerating pipe 3 by the compressed air (6 kgf/cm$^2$) blown out through a nozzle 2 to be discharged from the accelerating pipe outlet 13 into the pulverizing chamber 8, whereby the powdery starting material 7 was thrashed against the impinging surface 14 to be pulverized through the impact force. The powdery starting material was found to be accelerated to a velocity near the velocity of sound (about 340 m/s) within the accelerating pipe. At the same time, the powdery starting material impinged on the impinging surface 14 with a conical shape slanted at 120° was dispersed in the whole circumferential direction and secondarily on the opposed pulverizing chamber wall 6 to be further pulverized there.

The powdery starting material pulverized was conveyed smoothly from the discharging outlet 5 into the classifier 24, and the fine powder was removed as the classified powder and the coarse powder was thrown again together with the powdery starting raw material through the throwing inlet 1. As the fine powder, the pulverized powder with a weight mean particle size of 12 μm was collected at a rate of 30 kg/h.

Thus, since the impinging surface of the impinging member 4 has a conical shape slanted with an apex angle ($\theta$) of 120°, the powdery starting material impinged was dispersed in the whole circumferential direction and impinged secondarily on the opposed pulverizing wall. Accordingly, there occurred no fusion, agglomerated product, coarse particles near the impinging member and therefore the powder concentration was not increased, and further due to secondary impinging, the pulverizing ability was confirmed to be much higher than in the prior art.

EXAMPLE 2

When the same powdery starting material as in Example 1 was pulverized in the same manner as in Example 1 by use of an impinging member having an impinging surface of a conical shape slanted with an apex angle ($\theta$) of 160° shown in FIG. 3, the powder concentration near the impinging surface during pulverization was not increased and also due to secondary impinging, the pulverizing ability was confirmed to be much higher than in the prior art. The amount of the powdery starting material was controlled depending on the amount to be treated.

EXAMPLE 3

When the same powdery starting material as in Example 1 was pulverized in the same manner as in Example 1 by use of an impinging member having an impinging surface of a conical shape slanted with an apex angle ($\theta$) of 170° shown in FIG. 4, the powder concentration near the impinging surface during pulverization was not increased and also due to secondary impinging, the pulverizing ability was confirmed to be much higher than in the prior art.

COMPARATIVE EXAMPLE 1

The same powdery starting material as in Example 1 was pulverized in the gas stream type pulverizer of the prior art as shown in FIG. 5. In said pulverizer, by use of an impinging member 4 having a planar impinging surface 14 vertical to the accelerating pipe 3, pulverization was conducted in the same manner as in Example 1. Since the powdery starting material impinged on the impinging surface 14 was reflected in the direction opposed to the discharging direction, the powder concentration near the impinging surface became remarkably high. For this reason, when the feeding rate of the powdery starting material exceeded 10 kg/h, fusion and sticking, agglomerated product, coarse particles began to occur on the impinging member, whereby fused products may sometimes clog the accelerating pipe outlet 3 or the classifier. Accordingly, the amount of pulverization treatment must be lowered to 10 kg per hour, which became the limit of the pulverizing ability.

COMPARATIVE EXAMPLE 2

Figure 6:
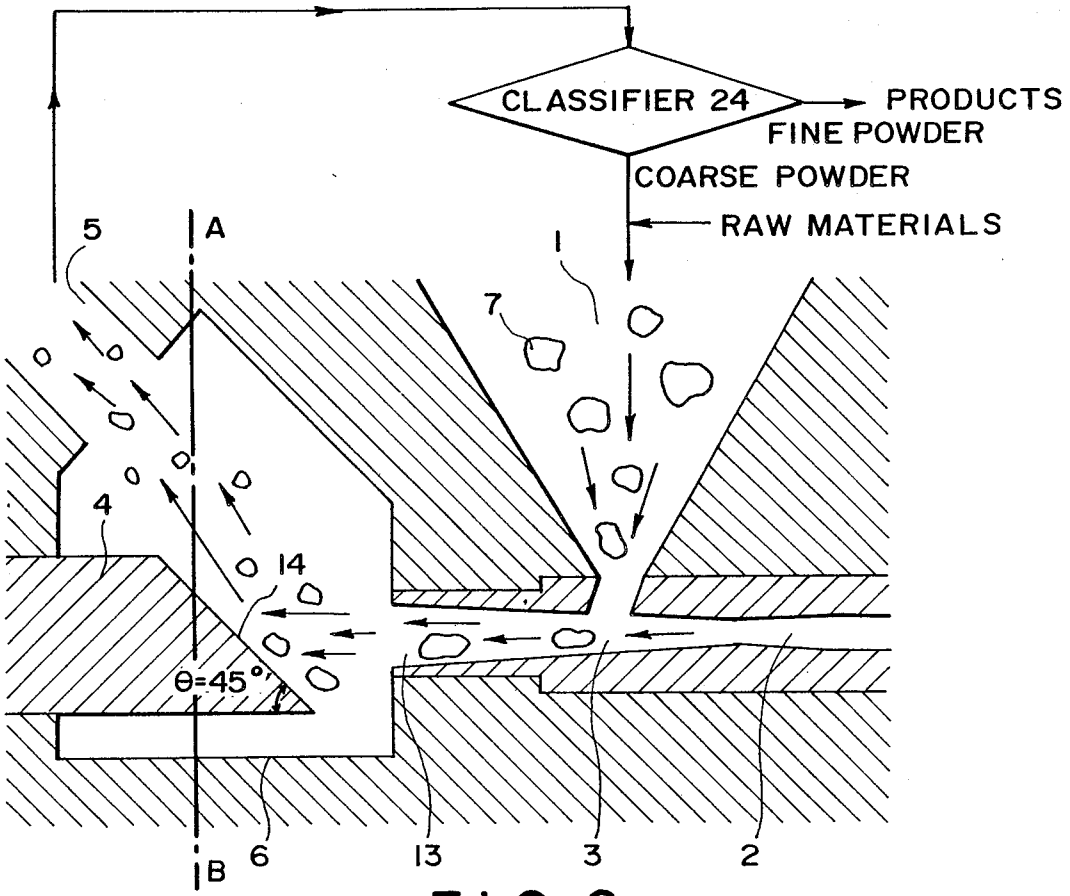
FIG. 6 PRIOR ART
FIG. 6 illustrates schematically a cross-section of a pneumatic pulverizer as a comparative example with the impinging surface of the impinging member being slanted upwardly at 45° relative to the axial direction of the accelerating pipe and pulverization-classification steps.
Figure 7:
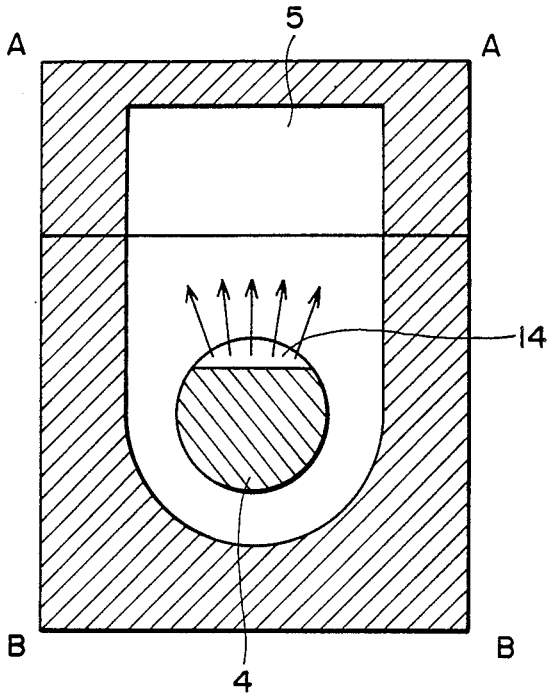
FIG. 7 PRIOR ART
FIG. 7 illustrates schematically a cross-section at the A-B plane of the pneumatic pulverizer shown in FIG. 6.

The same powdery starting material as in Example 1 was pulverized by a pneumatic pulverizer shown in FIG. 6 and FIG. 7. In said pulverizer, by use of an impinging member having an impinging surface of 45°, pulverization was conducted in the same manner as in Example 1. As the result, the powdery starting material impinged on the impinging surface was reflected in the direction departing from the accelerating pipe outlet 13 as compared with Comparative example 1, and therefore no fusion and agglomerated product occurred. However, because the impact force was weakened during impinging, the pulverization efficiency was poor and only 10 kg/h of the fine powder with a weight average particle size of 12 μm could be obtained.

COMPARATIVE EXAMPLE 3

Figure 10:
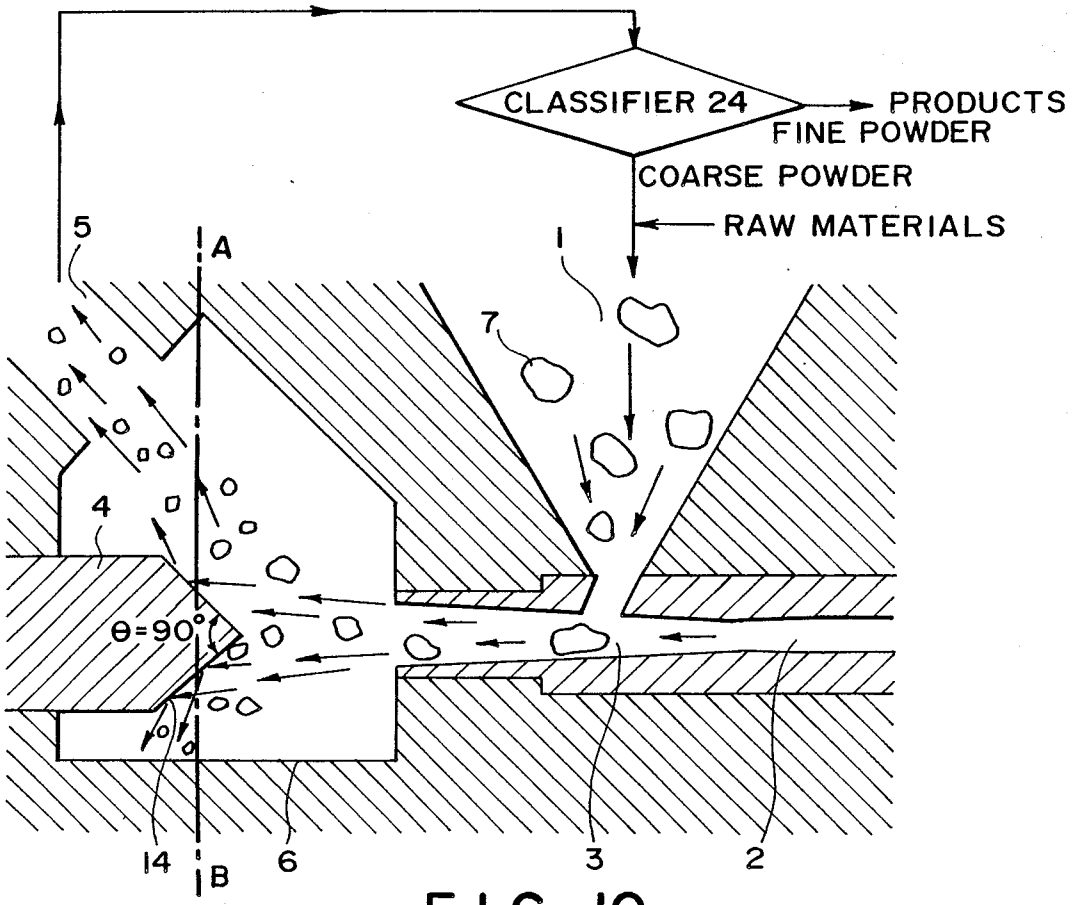
FIG. 10 illustrates schematically a cross-section of a pneumatic pulverizer as a comparative example with the conical impinging surface of the impinging member having an apex angle of 90° and pulverization-classification steps.
Figure 11:
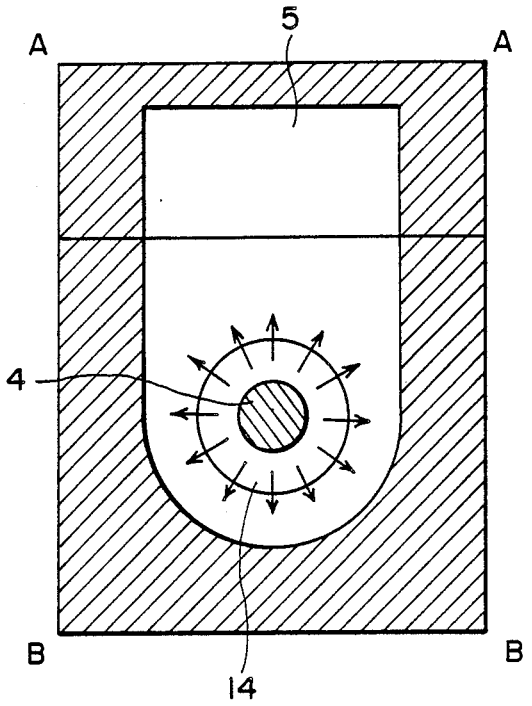
FIG. 11 illustrates schematically a cross-section at the A-B plane of the pneumatic pulverizer shown in FIG. 10.

The same powdery starting material as in Example 1 was pulverized by a pneumatic pulverizer shown FIG. 10 and FIG. 11. In said pulverizer, by use of an impinging member having an impinging surface of a conical shape slanted with an apex angle ($\theta$) of 90°, pulverization was conducted in the same manner as in Example 1. As the result, since the powdery starting material impinged on the impinged surface was dispersed rearward, no fusion and agglomerated product occurred. However, because the impact force was weakened during impinging, the pulverization efficiency was poor and only about 10 kg/h of the fine powder with a weight average particle size of 12 μm could be obtained.

COMPARATIVE EXAMPLE 4

Figure 8:
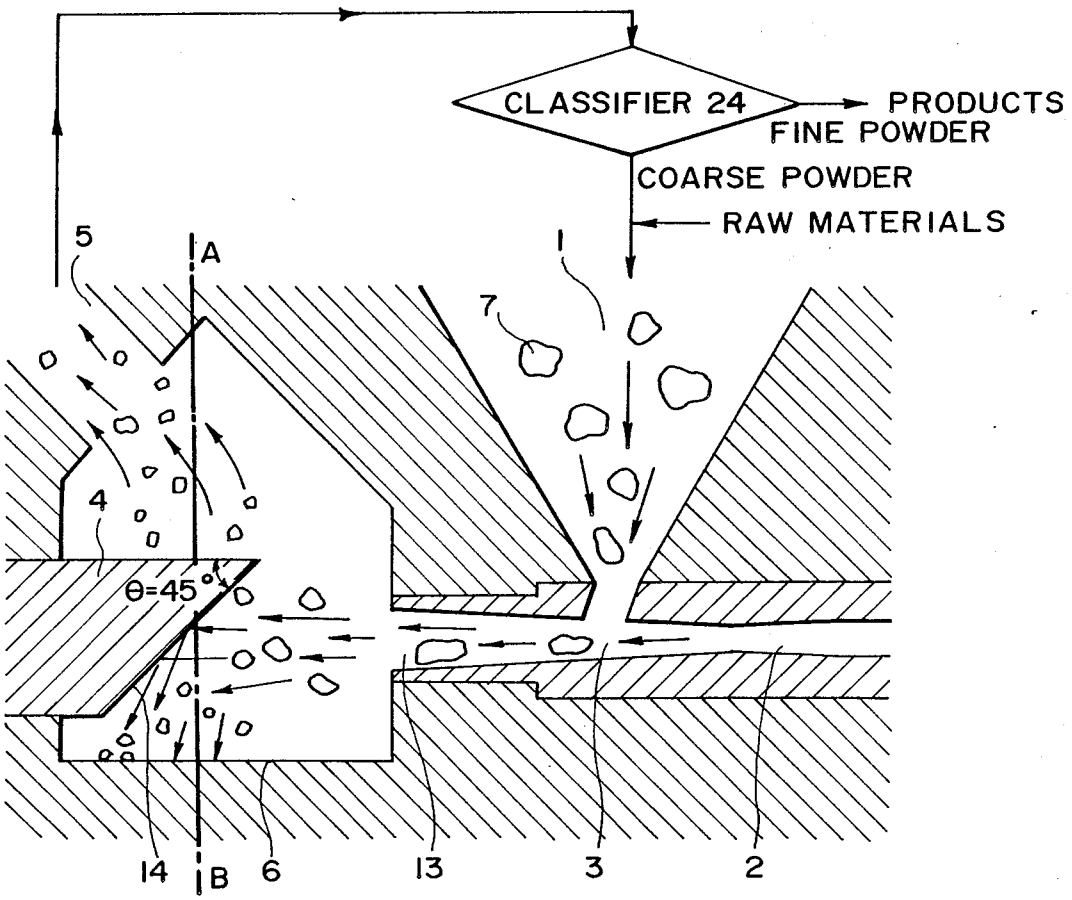
FIG. 8 PRIOR ART
FIG. 8 illustrates schematically a cross-section of a pneumatic pulverizer as a comparative example with the impinging surface of the impinging member being slanted downwardly at 45° relative to the axial direction of the accelerating pipe and pulverization-classification steps.
Figure 9:
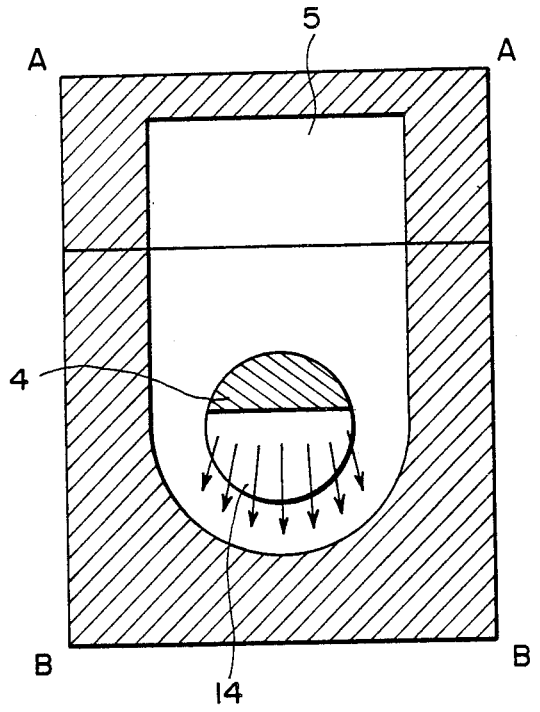
FIG. 9 PRIOR ART
FIG. 9 illustrates schematically a cross-section at the A-B plane of the pneumatic pulverizer shown in FIG. 8.

The same powdery starting material as in Example 1 was pulverized by a pneumatic pulverizer shown in FIG. 8 and FIG. 9. In said pulverizer, by use of an impinging member having an impinging surface of 45°, pulverization was conducted in the same manner as in Example 1. As the result, no fusion and agglomeration product occurred. However, because the impact force was weakened during impinging and also utilization of secondary impinging on the pulverizing chamber wall was still insufficient, only about 1.1 kg/h of the fine powder with a weight average particle size of 12 μm could be obtained.

The results in Examples 1 to 3 and Comparative examples 1 to 4 are shown below in Table 1.

TABLE 1

| | Kind of pulverizer | Yield of fine powder (per hour) | Treating* ability |
|---|---|---|---|
| Example 1 | Pulverizer in FIG. 1 (conical impinging surface, apex angle 120° | 30 kg | 3.0 |
| Example 2 | Pulverizer in FIG. 3 (conical impinging surface, apex angle 160° | 33 kg | 3.3 |
| Example 3 | Pulverizer in FIG. 4 (conical impinging surface, apex angle 170° | 27 kg | 2.7 |
| Comparative example 1 | Pulverizer in FIG. 5 | 10 kg | 1.0 |
| Comparative example 2 | Pulverizer in FIG. 6 | 10 kg | 1.0 |
| Comparative example 3 | Pulverizer in FIG. 10 | 10 kg | 1.0 |
| Comparative example 4 | Pulverizer in FIG. 8 | 11 kg | 1.1 |

*The treating ability of the pulverizer in Comparative example 1 was made 1.

EXAMPLE 4

As the powdery starting material, the following composition was used.

| | |
|---|---|
| Styrene-butyl acrylate (Mw =200000, Tg =60° C.) | 100 parts by weight |
| Magnetic powder (Magnetite, average particle size 0.3 μm) | 60 parts by weight |
| Low molecular weight polyethylene | 2 parts by weight |
| Negatively chargeable controlling agent (azo type metal complex) | 2 parts by weight |

The toner starting material comprising a mixture of the above recipe was melted and kneaded at about 180° C. for about 1.0 hour, solidified by cooling, the solid product was coarsely pulverized by a hammer mill into particles of 100 to 1000 μm and used as the powdery starting raw material.

The powdery starting material was fed at a rate of 9.1 kg/h through the throwing inlet 1, compressed air of 6 kgf/cm$^2$ introduced through the nozzle 2 to effect pulverization in a pneumatic pulverizer shown in FIG. 1 and FIG. 2, and the pulverized powder was classified into fine powder and coarse powder. As the fine powder, powder with a weight average particle size of 12 μm was collected at a rate of 9.1 kg per hour.

EXAMPLE 5

The same powdery starting material as in Example 4 was pulverized in the same manner as in Example 4 by use of a pneumatic pulverizer shown in FIG. 3 equipped with an impinging member having a conical impinging surface slanted with an apex angle ($\theta$) of 160°. As the result, the fine powder with a weight average particle size of about 2 μm was collected at a rate of 9.8 Kg per hour. The amount of the powdery starting material was controlled depending on the amount to be treated.

EXAMPLE 6

The same powdery starting material as in Example 4 was pulverized in the same manner as in Example 4 by use of a pneumatic pulverizer shown in FIG. 3 equipped with an impinging member having a conical impinging surface slanted with an apex angle ($\theta$) of 170°. As the result, the fine powder with a weight average particle size of about 12 μm was collected at a rate of 8.4 kg per hour.

COMPARATIVE EXAMPLE 5

When the same powdery starting material as in Example 4 was pulverized by a pneumatic pulverizer shown in FIG. 5, only 7 Kg/h of the fine powder with a weight average particle size of about 12 μm could be obtained.

COMPARATIVE EXAMPLE 6

When the same powdery starting material as in Example 4 was pulverized by a pneumatic pulverizer shown in FIG. 6 and FIG. 7, only 4.2 kg/h of the fine powder with a weight average particle size of about 12 μm could be obtained.

COMPARATIVE EXAMPLE 7

When the same powdery starting material as in Example 4 was pulverized by a pneumatic pulverizer shown in FIG. 10 and FIG. 11, only 7.7 kg/h of the fine powder with a weight average particle size of about 12 μm could be obtained.

The results in Examples 4 to 6 and Comparative examples 5 to 7 are shown below in Table 2.

TABLE 2

| | Kind of pulverizer | Yield of fine powder (per hour) | Treating* ability |
|---|---|---|---|
| Example 4 | Pulverizer in FIG. 1 | 9.1 kg | 1.3 |
| Example 5 | Pulverizer in FIG. 3 | 9.8 kg | 1.4 |
| Example 6 | Pulverizer in FIG. 4 | 8.4 kg | 1.2 |
| Comparative example 5 | Pulverizer in FIG. 5 | 7 kg | 1.0 |
| Comparative example 6 | Pulverizer in FIG. 6 | 4.2 kg | 0.6 |
| Comparative example 7 | Pulverizer in FIG. 10 | 7.7 kg | 1.1 |

*The treating ability of the pulverizer in Comparative example 5 was made 1.

EXAMPLE 7

Figure 13:
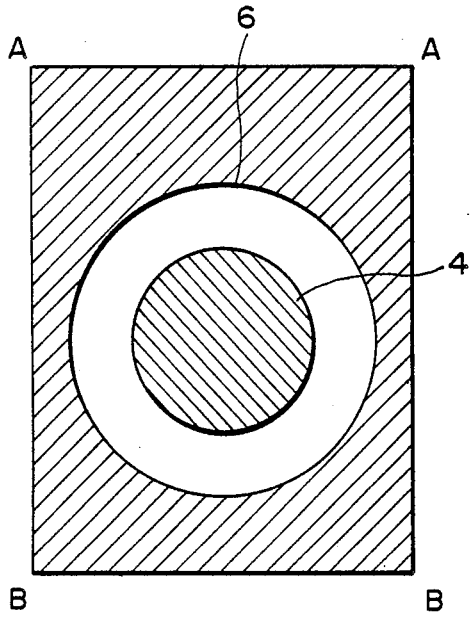

The powdery starting material was pulverized by a pneumatic pulverizer shown in FIG. 12 and FIG. 13.

The distance (a) from the accelerating pipe outlet to the impinging surface was 50 mm, the diameter (b) of the impinging member was 60 mm, the distance (c) from the impinging surface to the pulverizing chamber wall was 20 mm and the apex angle $\theta$ of the impinging surface 160°.

Further, the shape of the pulverizing chamber wall was circular, and the discharging outlet 5 was provided in the axial direction of the impinging member.

As the powdery starting material, the following composition was used.

| | |
|---|---|
| Styrene-acrylate resin | 100 parts by weight |
| Magnetite | 60 parts by weight |
| Low molecular weight polyethylene | 2 parts by weight |
| Negatively chargeable controlling agent (azo type metal comptex) | 2 parts by weight |

The toner starting material comprising a mixture of the above recipe was melted and kneaded at 180° C. for about 1.0 hour, solidified by cooling, coarsely pulverized by a hammer mill to particles of 100 to 1000 μm and used as the powdery starting raw material.

When the powdery starting material was fed through the throwing inlet 1, the powdery starting material was thrashed against the impinging surface of the iminging member 4 by the compressed air blown out from the nozzle 2 and pulverized through its impact force. At the same time, the impinging surface of the impinging member had a conical shape slanted with an apex angle of 160°, whereby the impinged powdery starting material was dispersed in the whole circumferential direction and impinged secondarily on the opposed pulverizing chamber wall 4 to be further pulverized.

The powdery starting material pulverized was conveyed smoothly through the discharging outlet 5 into the classifier, where the fine powder was removed as the product, and the coarse powder was again thrown through the throwing inlet together with the powdery starting raw material. Since no fusion, agglomerated product, coarse particle occurred, pulverizing ability was not weakened to enable elevation of powder concentration during pulverization, and strong impact force could be maintained up to secondary impinging. As the overall result, improvement of pulverization efficiency by 80 to 100% as compared with the device having an impinging surface vertical to the accelerating pipe could be effected.

EXAMPLE 8

The same powdery starting material as in Example 7 was effected by means of a gas stream type pulverizer shown in FIG. 14 and FIG. 15.

In Example 8, since no fusion, agglomerated product, or coarse particle occurred, the pulverizing ability was not weakened to enable elevation of powder concentration during pulverization, and strong impact force could be maintained up to secondary impinging. As the overall result, improvement of pulverization efficiency by 20 to 50% as compared with the device having an impinging surface vertical to the accelerating pipe could be effected.

What is claimed is:

1. A pneumatic pulverizer comprising:

an accelerating pipe for conveying and accelerating powder by a high pressure gas;

a pulverizing chamber defined by wall portions which receives the powder from an accelerating pipe outlet of said accelerating pipe;

an impinging member, disposed in said pulverizing chamber opposite to said accelerating pipe outlet, for pulverizing the powder jetted out from said acceleration pipe outlet, said impinging member having a diameter and an impinging surface with a conically shaped tip portion with an apex angle between 110° and 175°, wherein an inner diameter of said accelerating pipe outlet is smaller than the diameter of said impinging member, and said impinging member is disposed such that the shortest distance between said impinging member and said pulverizing chamber wall portions is 0.1 to 1 times the diameter of said impinging member, and wherein the powder is pulverized at said impinging surface of said impinging member and dispersed substantially in the entire circumferential direction of said impinging surface and the dispersed powder impinges secondarily on said wall portions of said pulverizing chamber.

2. A pneumatic pulverizer according to claim 1, wherein said tip portion of said impinging surface of said impinging member has an apex angle between 120° and 170°.

3. A pneumatic pulverizer according to claim 1, wherein said impinging member has a circular cylindrical shape and said tip portion has a conical shape.

4. A pneumatic pulverizer according to claim 1, wherein said accelerated pipe outlet has an inner diameter of 10 to 100 mm, and said impinging member has a circular cylindrical shape.

5. A pneumatic pulverizer according to claim 4, wherein said impinging member is arranged so that the distance between said tip portion of said impinging surface of said impinging member and said accelerating pipe outlet is 0.5 to 2 times the diameter of said impinging member.

6. A pneumatic pulverizer according to claim 1, wherein said impinging member is made of a ceramic material and said inner wall of said pulverizing chamber is coated with a ceramic material.

7. A pneumatic pulverizer according to claim 1, wherein a pulverizing chamber wall portion disposed substantially perpendicular to an axial direction of said impinging member is U-shaped.

8. A pneumatic pulverizer according to claim 1, wherein a pulverizing chamber wall portion disposed substantially perpendicular to an axial direction of said impinging member has a circular shape.

9. A pneumatic pulverizer according to claim 1, wherein at least a surface of said impinging member is made of a ceramic material.

10. A pneumatic pulverizer according to claim 1, wherein at least inner wall surfaces of said pulverizing chamber wall portions are made of a ceramic material.

11. A pneumatic pulverizer according to claim 1, wherein said impinging member is made of a ceramic material.

12. A pneumatic pulverizer according to claim 1, wherein said impinging member is coated with a ceramic material.

13. A pneumatic pulverizer according to claim 1, wherein said impinging member is made of an aluminum oxide-type ceramic material.

14. A pneumatic pulverizer according to claim 1, wherein said impinging member is coated with an aluminum oxide-type ceramic material.

15. A method for pneumatically pulverizing powder, comprising the steps of:

conveying and accelerating powder by a high pressure gas within an accelerating pipe;

discharging the powder from an accelerating pipe outlet of the accelerating pipe into a pulverizing chamber defined by wall portions;

pulverizing the powder by impinging the powder against the impinging surface of an impinging member with the impinging surface having a conically shaped tip portion disposed inside the pulverizing chamber with an apex angle between 110° and 175°, wherein an inner diameter of the accelerating pipe outlet is smaller than a diameter of the impinging member;

dispersing the impinged powder substantially in the entire circumferential direction of the impinging surface;

further pulverizing the powder by impinging it secondarily on the pulverizing chamber wall portions; and arranging the impinging member so that the shortest distance between the impinging member and the pulverizing chamber wall portions is 0.1 to 1 times the diameter of the impinging member.

16. A method according to claim 15, further comprising the step of accelerating the powder by a compressed gas of 3 to 10 kgf/cm$^2$ within the accelerating pipe and discharging it from the accelerating pipe outlet.

17. A method according to claim 16, further comprising the step of accelerating the powder to a velocity of 300 to 400 m/s within the accelerating pipe.

18. A method according to claim 15, wherein the tip portion of the impinging surface of the impinging member has a conical shape with an apex angle between 120° and 170°.

19. A method according to claim 15, wherein the powder comprises mainly a resin having a glass transition point between 50° and 120° C.

20. A method according to claim 19, wherein the resin comprises a styrene type resin, an epoxy resin or a polyester type resin.

21. A method according to claim 15, wherein the powder has an average particle size of 30 to 1000 μm, and further comprising the steps of pulverizing the powder at the impinging surface and the pulverizing chamber wall portions, classifying the pulverized powder into fine powder and coarse powder and again feeding the coarse powder into the accelerating pipe.

22. A method according to claim 21, wherein the fine powder has an average particle size of 5 to 20 μm.

23. A method according to claim 15, wherein the impinging member is made of a ceramic material.

24. A method according to claim 15, wherein the impinging member is coated with a ceramic material.

25. A method according to claim 15, wherein the impinging member is made of an aluminum oxide-type ceramic material.

26. A method according to claim 15, wherein the impinging member is coated with an aluminum oxide-type ceramic material.

27. A method according to claim 15, wherein the impinging member is made of a ceramic material and the inner wall of the pulverizing chamber is coated with a ceramic material.

* * * * *

UNITED STATES PATENT AND TRADEMARK OFFICE
CERTIFICATE OF CORRECTION

PATENT NO. : 4,930,707

DATED : June 5, 1990

INVENTOR(S) : Mayumi Kashiwagi, et al

It is certified that error appears in the above-identified patent and that said Letters Patent is hereby corrected as shown below:

Title page:

UNITED STATES PATENT [19]

"Oshiro et al." should read --Kashiwagi, et al--.

[75] Inventors:

"all of" should read --all of Japan--.

[30] Foreign Application Priority Data

Insert

--Nov. 2, 1988 [JP] Japan .....63-276165--.

Column 12:

Line 33, "accelerated" should read --accelerating--.

Line 57, "accelerated" should read --accelerating--.

Signed and Sealed this

Twentieth Day of August, 1991

*Attest:*

*Attesting Officer*

HARRY F. MANBECK, JR.

*Commissioner of Patents and Trademarks*